US011598089B2

(12) United States Patent
Ohuchi et al.

(10) Patent No.: US 11,598,089 B2
(45) Date of Patent: Mar. 7, 2023

(54) PARTITION WALL

(71) Applicant: YOSHINO GYPSUM CO., LTD., Tokyo (JP)

(72) Inventors: Wataru Ohuchi, Tokyo (JP); Kouji Yamakata, Tokyo (JP); Yusuke Ichino, Tokyo (JP); Shunichi Hatakeyama, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 252 days.

(21) Appl. No.: 17/279,175

(22) PCT Filed: Jul. 4, 2019

(86) PCT No.: PCT/JP2019/026625
§ 371 (c)(1),
(2) Date: Mar. 24, 2021

(87) PCT Pub. No.: WO2020/070938
PCT Pub. Date: Apr. 9, 2020

(65) Prior Publication Data

US 2021/0396003 A1 Dec. 23, 2021

(30) Foreign Application Priority Data

Oct. 1, 2018 (JP) ..... JP2018-186960

(51) Int. Cl.
*E04B 1/94* (2006.01)
*E04B 2/58* (2006.01)

(52) U.S. Cl.
CPC ..... *E04B 1/948* (2013.01); *E04B 2/58* (2013.01)

(58) Field of Classification Search
CPC ..... E04B 1/948; E04B 2/58; E04B 2/7457; E04B 2/7411

(Continued)

(56) References Cited

U.S. PATENT DOCUMENTS 2,347,756 A * 5/1944 Swenson ..... E04B 2/962 277/921
3,866,376 A * 2/1975 Nelsson ..... E04B 2/7401 52/762

(Continued)

FOREIGN PATENT DOCUMENTS

CN 106906919 A * 6/2017 ..... E04B 1/942
JP 2000-297492 10/2000

(Continued)

OTHER PUBLICATIONS

Yoshino Gypsum Co., Ltd., "Easywall 25", catalog, Apr. 2018 with partial translation.

(Continued)

*Primary Examiner* — Brian D Mattei
*Assistant Examiner* — Joseph J. Sadlon
(74) *Attorney, Agent, or Firm* — IPUSA, PLLC

(57) ABSTRACT

A fire-resistant partition wall includes wall studs and first and second walls each including gypsum boards with vertical and lateral joints. The wall studs are on the back side of the vertical joints. A joint base member is provided at the lateral joints. The gypsum boards, the joint base member, and the wall studs are not screwed with a common screw, and (a) the gypsum boards are screwed to only the wall studs and are not screwed to the joint base member, and the joint base member is fixed to the lateral joint position by being inserted between the gypsum boards and the wall studs, or (b) the gypsum boards are screwed to the wall studs and to the joint base member with different screws, and the joint base member is fixed to the lateral joint position by being inserted between the gypsum boards and the wall studs.

11 Claims, 7 Drawing Sheets

(58) Field of Classification Search
USPC ..... 52/460
See application file for complete search history.

(56) References Cited

U.S. PATENT DOCUMENTS 3,934,066 A * 1/1976 Murch ..... B32B 27/12 442/221
4,043,086 A * 8/1977 Kaulfuss ..... E04B 2/7405 52/461
4,660,339 A * 4/1987 Paz ..... E04F 13/0803 52/460
4,840,004 A * 6/1989 Ting ..... E04F 13/0803 52/235
4,854,107 A * 8/1989 Roberts ..... E04B 9/005 52/834
5,245,811 A * 9/1993 Knorr ..... E04B 2/7409 52/243
5,475,961 A * 12/1995 Menchetti ..... E04B 2/7411 52/282.1
5,485,706 A * 1/1996 Menchetti ..... E04F 17/005 52/840
5,885,029 A * 3/1999 Kotani ..... E04F 13/08 52/460
6,032,426 A * 3/2000 Tamlyn ..... E04F 19/02 52/287.1
6,430,883 B1 * 8/2002 Paz ..... A47F 5/105 52/27
7,661,234 B2 * 2/2010 Voegele, Jr. ..... E04D 3/363 52/459
7,748,182 B2 * 7/2010 McGee ..... E04B 2/7457 52/287.1
8,051,623 B2 * 11/2011 Loyd ..... E04F 13/0803 52/489.1
8,567,145 B1 * 10/2013 Chauncey ..... E04F 13/0801 52/404.3
8,769,898 B2 * 7/2014 Carolan ..... E04B 2/90 52/235
8,839,582 B2 * 9/2014 Aboukhalil ..... E04F 19/062 52/460
9,677,268 B2 * 6/2017 Knight ..... E04B 1/7608
10,311,444 B1 * 6/2019 Conboy ..... G06Q 30/0635
2001/0034988 A1 * 11/2001 Hsueh ..... E04B 2/7455 52/27
2013/0318904 A1 * 12/2013 Miller ..... E04B 2/7411 52/483.1
2019/0177971 A1 * 6/2019 Outram ..... C09K 21/02

FOREIGN PATENT DOCUMENTS

JP 2009-191494 8/2009
JP 2012-144962 8/2012
JP 2018-091123 6/2018

OTHER PUBLICATIONS

International Search Report for PCT/JP2019/026625 dated Sep. 24, 2019.
Written Opinion of the International Searching Authority for PCT/JP2019/026625 dated Sep. 24, 2019.

* cited by examiner

PARTITION WALL

TECHNICAL FIELD

The present disclosure relates to partition walls.

BACKGROUND ART

Partition walls having a 60-minute fire-resistance rating, being capable of preventing the temperature of a non-heated surface from rising to or above a temperature at which a combustible contacting the non-heated surface may burn when fire heat due to a fire is applied to a heated surface for one hour, are known. Conventional partition walls thus having a fire resistance capability of one hour are formed by screwing two walls to multiple wall studs (or studs) formed of light-gauge steel installed at predetermined intervals such that the wall studs are sandwiched between the two walls.

Each of the two walls has a multilayer structure of at least two sheets of fire-resistant covering material, such as a base layer reinforced gypsum board and a top layer reinforced gypsum board, and accordingly, the partition wall as a whole has a structure of four or more layers of fire-resistant covering material. In each of the two walls, multiple fire-resistant coverings are vertically and horizontally arranged to form lateral joints and vertical joints. When a room fire breaks out, the fire-resistant coverings are exposed to fire heat to shrink, so that gaps are formed in the joints that are formed by gaplessly abutting the fire-resistant coverings to each other. Therefore, in the case of a single layer of fire-resistant covering material, heated air leaks out through the gaps in the joints. Accordingly, it is common to have a fire-resistant structure of four layers in total, two layers on each side, the same as the above-described partition wall, and offset the joint positions between the first layer and the second layer and between the third layer and the fourth layer, thereby preventing heated air from leaking out through gaps in the joints.

Here, consideration is given to a double-sided partition wall having one layer on each side for better workability, in which in general, (fire-resistant coverings are arranged such that) there are wall studs on the back side of the vertical joints of fire-resistant coverings, and accordingly, there is no risk that heated air leaks out through vertical joints when a room fire breaks out.

In contrast, there are no wall studs on the back side of substantially all lateral joints. Therefore, there is a risk that heated air leaks out into the partition wall through lateral joints. Such a leak of heated air through lateral joints may degrade the fire resistance capability of the partition wall. Furthermore, when a partition wall having a 60-minute fire-resistance rating is developed, normally, a 60-minute fire resistance test is conducted by applying heat for one hour, and the partition wall can be certified by the minister by passing this fire resistance test. The leakage of heated air through lateral joints makes it difficult to pass this 60-minute fire resistance test.

Here, a partition wall structure that can improve fire resistance capability and facilitate construction work has been proposed. Specifically, the partition wall structure includes wall studs, a pair of fire-resistant partition walls formed of a base layer material and a coated top layer material attached thereto, and an extension material extended on the outer side of at least one of the partition walls (see, for example, Patent Document 1).

PRIOR ART DOCUMENT

Patent Document

Patent Document 1: Japanese Laid-open Patent Publication No. 2009-191494

SUMMARY OF THE INVENTION

Problems to be Solved by the Invention

According to the partition wall structure described in Patent Document 1 as well, each of the paired walls provided across the studs from each other (in which a single wall is a partition wall) includes two sheets of fire-resistant covering material, which are a base layer member and a coated top layer member, and one of the partition walls has the extension member. Therefore, the partition wall structure as a whole has five layers of fire-resistant covering material and accordingly has a problem in that more construction time and effort is required.

Furthermore, as described above, Patent Document 1 does not specifically describe a joint base member attached to parts corresponding to lateral joints. Therefore, it is assumed that the partition wall on each side has at least two layers of fire-resistant covering material in order to prevent heated air from leaking to the inside of the partition walls through lateral joints.

The present disclosure is made in view of the above-described problem, and has an object of providing a partition wall that includes as small a number as possible of fire-resistant coverings to have good workability and effectively prevents a leak of heated air through lateral joints to have a good fire resistance capability.

Means for Solving the Problems

To achieve the above-described object, an embodiment of a partition wall according to the present disclosure is a fire-resistant partition wall that includes multiple wall studs installed at predetermined intervals, and a first wall and a second wall that are a pair of walls provided across the wall studs from each other, the first wall and the second wall being formed of vertically and laterally arranged gypsum boards, wherein each of the first wall and the second wall is a single-layer wall of the gypsum boards, vertical joints and lateral joints are formed in each of the first wall and the second wall, the wall studs are on a back side of the vertical joints, and a joint base member having a fire blocking capability is provided at the lateral joints, the joint base member including a back piece contacting a back side of the gypsum boards and a projecting piece projecting from the back piece in a thickness direction of the gypsum boards, wherein a cross section of the joint base member perpendicular to a longitudinal direction thereof has a T-letter shape, and is characterized by the following screwing configuration (a) or (b), where the gypsum boards, the joint base member, and the wall studs are not screwed with a common screw:

(a) the gypsum boards are screwed to only the wall studs and are not screwed to the joint base member, and the joint base member is fixed to a position of the lateral joints by being inserted between the gypsum boards and the wall studs, and (b) the gypsum boards are screwed to the wall studs and to the joint base member with different screws, and the joint base member is fixed to a position of the lateral joints by being inserted between the gypsum boards and the wall studs.

That is, according to the configuration (a) of the partition wall according to the present disclosure, at the intersecting position of the three of the gypsum boards, the joint base member, and the wall studs (hereinafter referred to "three-member intersecting position"), the gypsum boards are screwed only to the wall studs at a position off the three-member intersecting position, and the joint base member is fixed by being inserted between the gypsum boards and the wall studs without being fasted with screws at the three-member intersecting position.

That is, according to the configuration (b) of the partition wall according to the present disclosure, at the three-member intersecting position of the three of the gypsum boards, the joint base member, and the wall studs, the gypsum boards are screwed to the joint base member and to the wall studs with different screws at a position off the three-member intersecting position, and the joint base member is fixed by being inserted between the gypsum boards and the wall studs without being fasted with screws at the three-member intersecting position.

Effects of the Invention

According to a partition wall of an embodiment of the present disclosure, it is possible to provide a partition wall that includes as small a number as possible of fire-resistant coverings to have good workability and effectively prevents a leak of heated air through lateral joints to have a good fire resistance capability.

EMBODIMENT OF THE INVENTION

Figure 1:
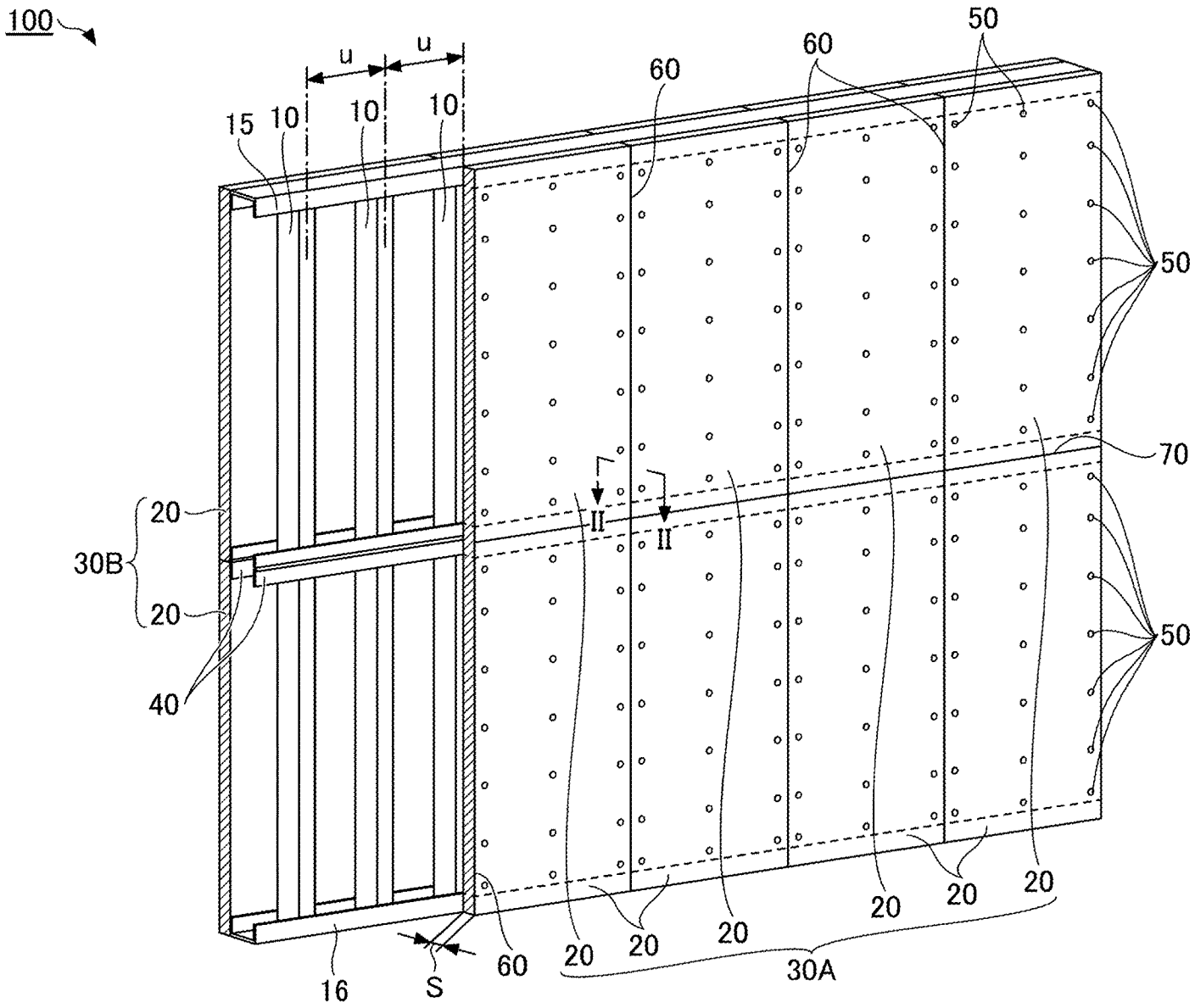
FIG. 1 is a perspective view of an example of a partition wall according to an embodiment, illustrating part thereof in a cutaway manner.

A partition wall according to an embodiment is described below with reference to the accompanying drawings. In the specification and drawings, substantially the same components are referred to using the same reference numerals, and a duplicate description thereof may be omitted.

[Partition Wall According to Embodiment]

Figure 2:
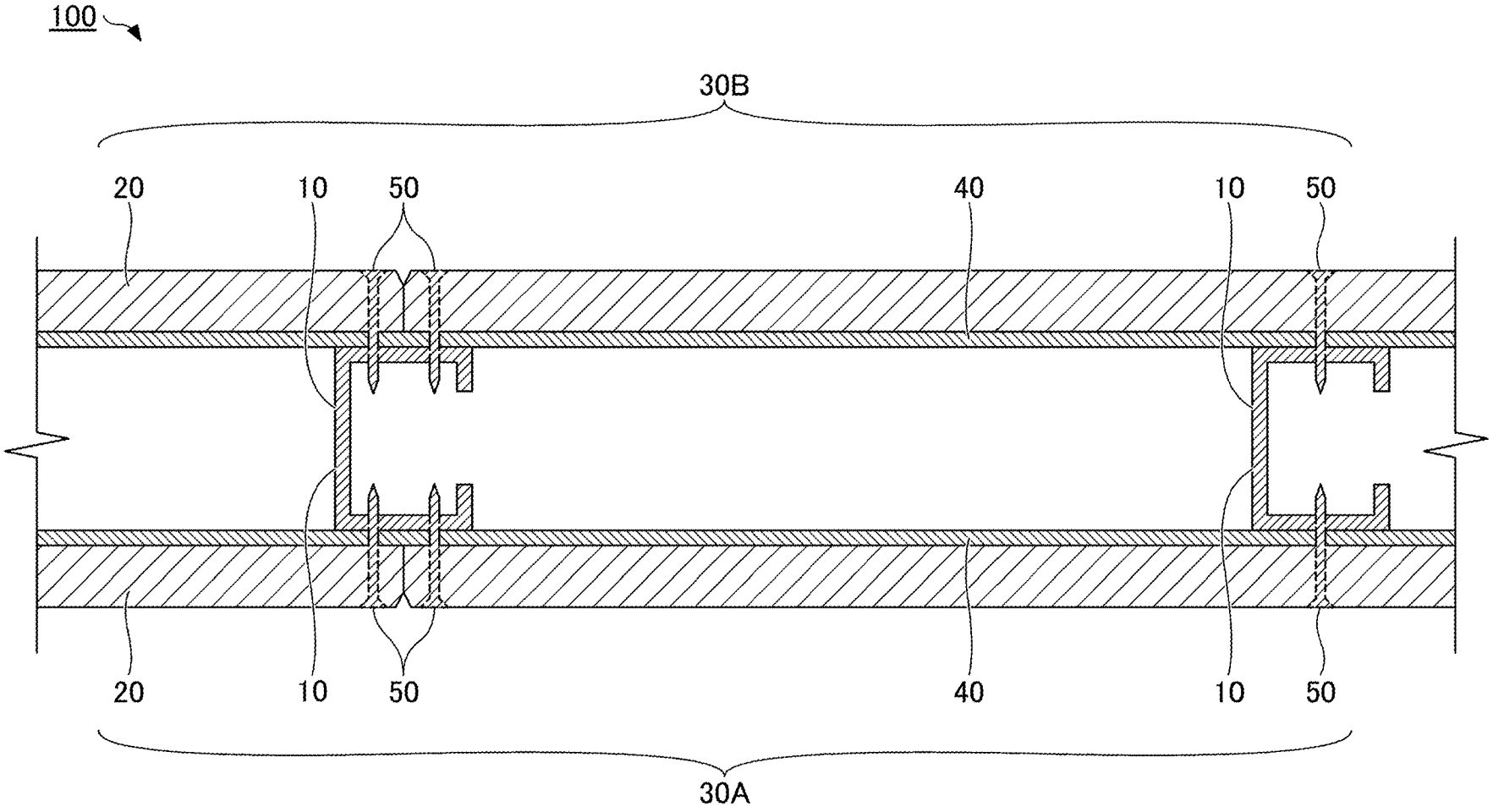
FIG. 2 is a cross-sectional view, looking at a section in which reinforced gypsum boards and wall studs are screwed together in the direction of the arrows II-II of FIG. 1.
Figure 3:
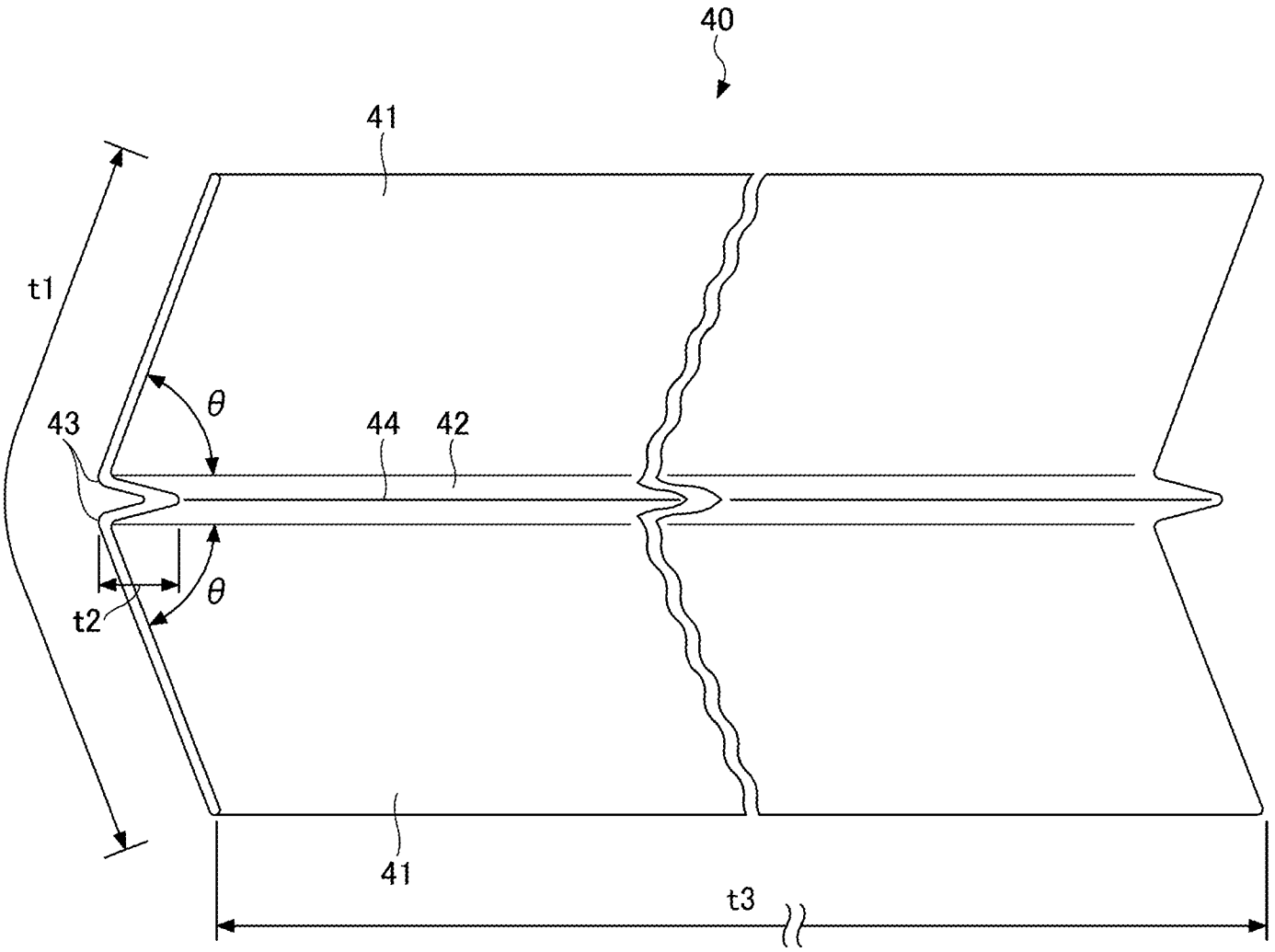
FIG. 3 is a perspective view of a joint base member.
Figure 4A:
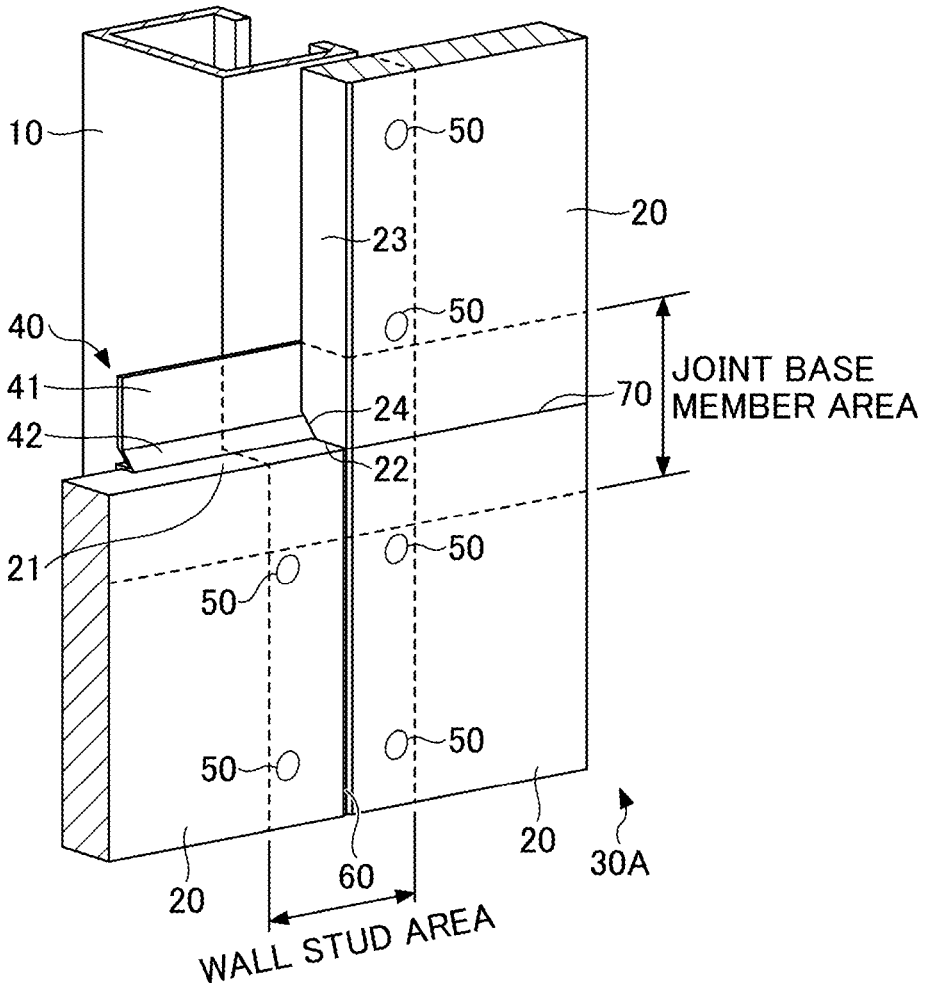
FIG. 4A is a perspective view illustrating a first wall on which the joint base member is provided on the back side of lateral joints, where the joint base member is not screwed to the reinforced gypsum boards.
Figure 4B:
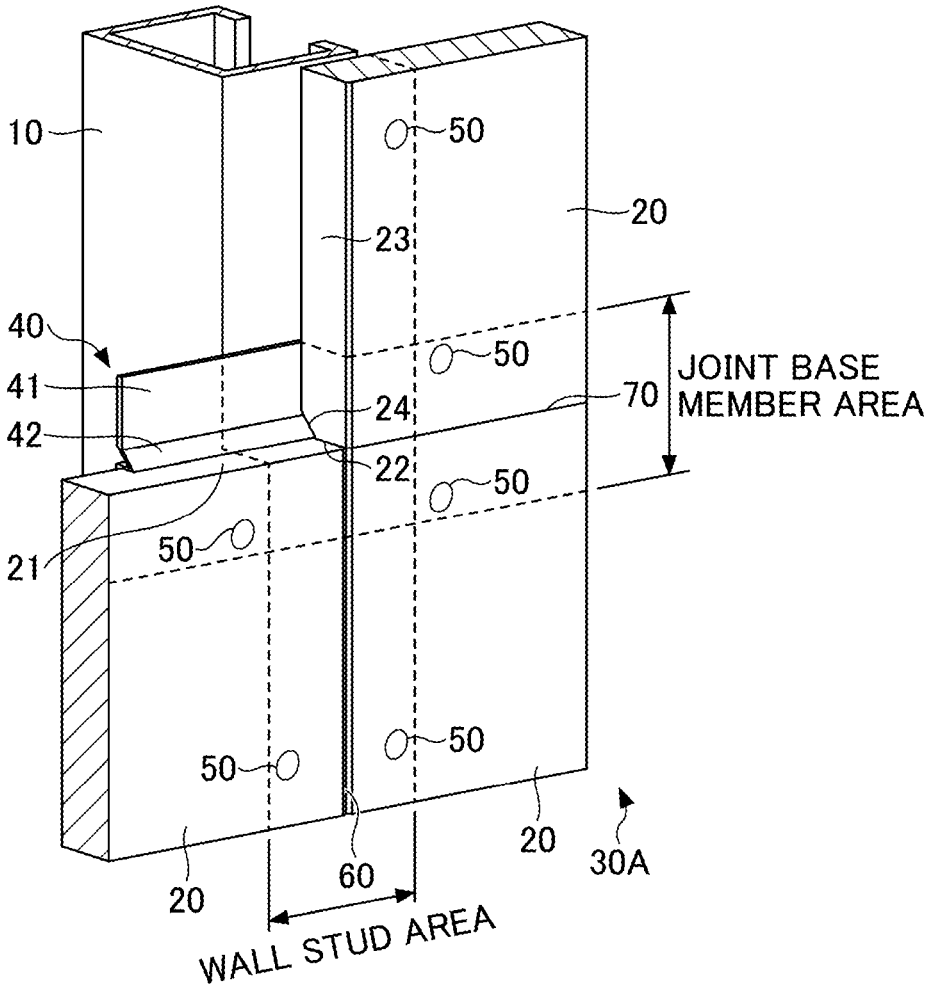
FIG. 4B is a perspective view illustrating a first wall on which the joint base member is provided on the back side of lateral joints, where the joint base member is screwed to the reinforced gypsum boards at position off a three-member intersecting position.
Figure 5:
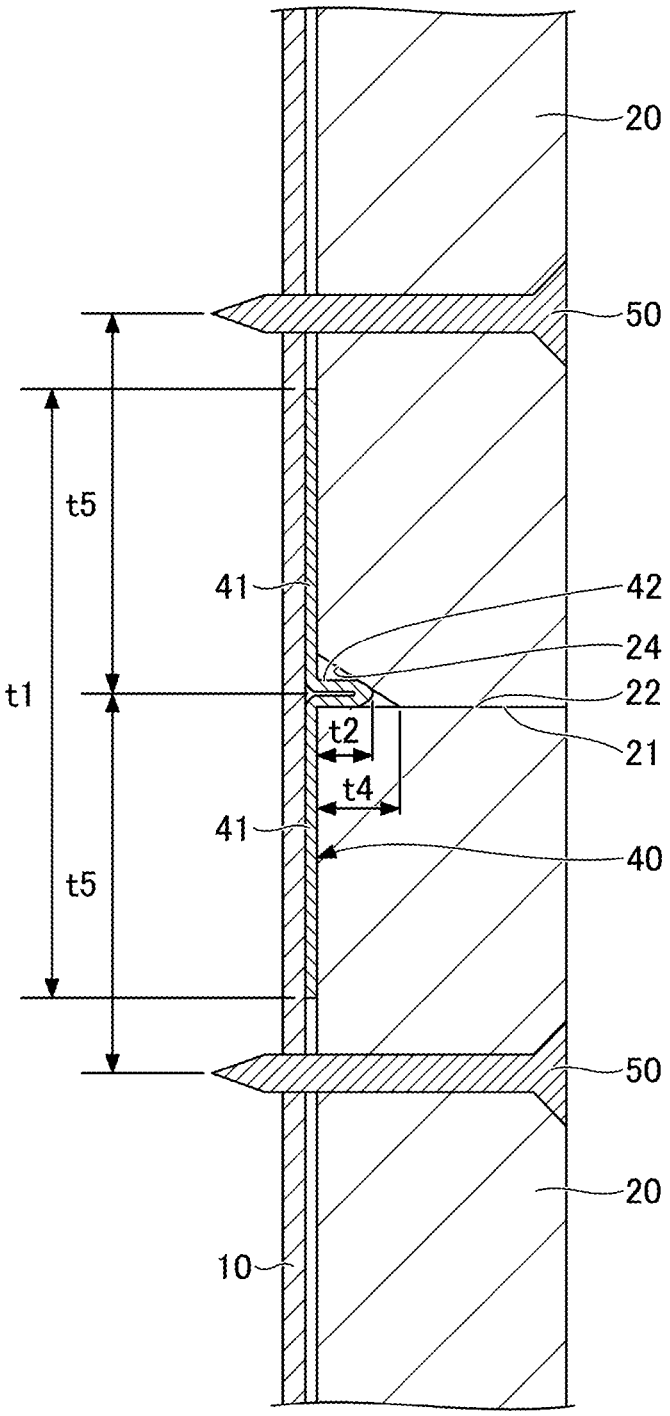
FIG. 5 is a longitudinal sectional view, looking at a section in which the reinforced gypsum boards and the wall stud are screwed together and the joint base member is fixed at a lateral joint position by being inserted between the reinforced gypsum boards and the wall stud without being screwed in the partition wall (an example) according to the embodiment.

A partition wall according to an embodiment is described with reference to FIGS. 1 through 5. In the following, a partition wall to which a reinforced gypsum board is applied as a gypsum board is taken up and described, while a gypsum board other than a reinforced gypsum board may be applied to the partition wall according to the embodiment. Here, FIG. 1 is a perspective view of an example of the partition wall according to the embodiment, illustrating part thereof in a cutaway manner. FIG. 2 is a cross-sectional view, looking at a section in which reinforced gypsum boards and wall studs are screwed together in the direction of the arrows II-II of FIG. 1. FIG. 3 is a perspective view of a joint base member. Furthermore, FIGS. 4A and 4B are perspective views illustrating a first wall on which the joint base member is provided on the back side of lateral joints. FIG. 5 is a longitudinal sectional view, looking at a section in which the reinforced gypsum board, the joint base member, and the wall stud are screwed together with common screws in the partition wall (an example) according to the embodiment.

As illustrated in FIG. 1, a partition wall 100 is a fire-resistant partition wall including multiple wall studs 10 (studs) installed at predetermined intervals u and a pair of a first wall 30A and a second wall 30B provided across the wall studs 10 from each other. The intervals u at which the wall studs 10 are installed may be constant or may change in the middle. The intervals u are, for example, 303 mm.

Each wall stud 10 is formed of lip channel steel. A lower runner 16 and an upper runner 15 are formed of channel steel. The wall studs 10 are fit into the respective grooves of the upper and lower runners 15 and 16, so that a frame structure is formed of the studs 10 and the upper and lower runners 15 and 16. The studs 10 may be formed of rectangular steel tubes instead of channel steel. The channel steel or rectangular steel tubes applied to the wall studs 10 are structural steel or steel tubes having, for example, 45 mm×45 mm×0.4 mm or more as width×height×thickness according to the expression of dimensions defined by JIS A 6517. Furthermore, the channel steel applied to the upper and lower runners 15 and 16 is structural steel of, for example, 45 mm×30 through 40 mm×0.4 mm or more.

Each of the first wall 30A and the second wall 30B is formed by vertically and laterally providing multiple reinforced gypsum boards 20 (examples of gypsum boards) having a thickness s of 25 mm. That is, by using the reinforced gypsum boards 20 of 25 mm in thickness, each of the first wall 30A and the second wall 30B can be formed of a single layer of fire-resistant covering material, and accordingly, the partition wall 100 as a whole is formed of two layers of the reinforced gypsum boards 20. Here, according to the partition wall 100 illustrated in FIG. 1, the first wall 30A and the second wall 30B are formed by applying the rectangular reinforced gypsum boards 20 in a vertical position, while the first wall 30A and the second wall 30B may also be formed by applying the reinforced gypsum boards 20 in a horizontal position.

The reinforced gypsum boards 20 are formed by mixing an inorganic fiber material into the core material portions of gypsum boards, and are boards higher in fire resistance performance than normal gypsum boards. According to JIS A 6901, the thickness standard of the reinforced gypsum boards 20 is defined as 12.5 mm, 15.0 mm, 16.0 mm, 18.0 mm, 21.0 mm and 25.0 mm (with a thickness tolerance of 0 mm to +0.5 mm).

According to the partition wall 100 of this embodiment, each of the first wall 30A and the second wall 30B is formed of a single layer of the reinforced gypsum boards 20. Therefore, the reinforced gypsum boards 20 having a maximum thickness of 25 mm are applied.

As these reinforced gypsum boards 20, "Tiger Board Type Z, 25 mm in thickness" manufactured by YOSHINO GYPSUM CO., LTD. may be applied. Tiger Board Type Z (25 mm in thickness) has a planar size of 606 mm in width and 1820 mm in length, and has a beveled edge.

Thus, the partition wall 100 as a whole has only two layers of the reinforced gypsum boards 20 and is therefore significantly improved in workability compared with conventional partition walls having four or more layers of fire-resistance covering material as a whole.

According to the partition wall 100 of the illustrated example, the predetermined intervals u at which the wall studs 10 are installed may be set to, for example, 303 mm, and the reinforced gypsum boards 20 each having a width over three wall studs 10 (the distance between the centers of the right wall stud 10 and the left wall stud 10) are applied.

Furthermore, the reinforced gypsum boards 20 are vertically and laterally provided to form multiple vertical joints 60 and lateral joints 70. The steel wall studs 10 are on the back side of the vertical joints 60. Accordingly, for example, when a fire breaks out from the first wall 30A side, there is no risk that heated air leaks into the partition wall 100 through the vertical joints 60 of the first wall 30A. Here, base members such as wall studs, which are illustrated as being made of steel according to the illustrated example, may alternatively be made of wood to the extent that they have a satisfactory fire resistance capability.

In contrast, there could be cavities on the back side of the lateral joints 70 except at positions corresponding to the wall studs 10, so that heated air could leak into the partition wall 100 through the lateral joints 70. Therefore, a joint base member 40 having a fire blocking capability is provided on the back side of the lateral joints 70.

Here, the "fire blocking capability" refers to the capability to block a leak of heated air or flame. In addition to materials having a fire resistance capability by nature and materials that are cured by heat to have a fire resistance capability, materials such as those that can have a fire blocking capability as a result of remaining as an incinerated mass even if the materials burn with heat are included.

Materials having a fire blocking capability as described above include metal, thermosetting resin, and wood. Metal includes steel, aluminum, and SUS (stainless steel). Thermosetting resin includes phenol formaldehyde resin (PF), epoxy resin (EP), melamine formaldehyde resin (MF), urea formaldehyde resin (UF), unsaturated polyester resin (UP), alkyd resin, polyurethane resin (PUR), and polyimide resin (PI). Furthermore, wood includes Japanese cedar, pine, spruce, quince, oak, and beech, and may be either solid wood or engineered wood. As described above, wood burns to remain as an incinerated mass to be able to have a fire blocking capability.

The illustrated partition wall 100 has the fire resistance capability of a 60-minute fire-resistance rating. A partition wall having a 60-minute fire-resistance rating is a partition wall that can pass a 60-minute fire resistance test conducted by applying heat for one hour to be certified by the minister. According to this fire resistance test, a temperature at which a combustible contacting a non-heated surface may burn is set as a reference temperature, and the temperature of the non-heated surface is required not to rise to or above this reference temperature.

More specifically, it is required that no damage that may let out fire (including heated air) be caused on the non-heated surface side by heating, that no damage that impairs structural strength be caused by heating, and that no significant smoke is produced on the non-heated surface side by heating. Furthermore, it is required that the temperature on the non-heated surface side neither exceed an initial temperature plus 140° C. as an average temperature nor exceed an initial temperature plus 180° C. as a maximum temperature.

As illustrated in FIG. 1, the joint base member 40 has a T-letter cross-sectional shape, and the reinforced gypsum boards 20 and the wall studs 10 are screwed together with screws 50 at positions where there are the wall studs 10 as illustrated in FIG. 4A. The applied screws include those having a diameter of 3.5 mm or more and a length of 35 mm or more. The screws may be fastened at vertical intervals of 200 mm or less. Here, FIG. 4A illustrates a configuration where the screws 50 fasten the reinforced gypsum boards 20 and the wall stud 10 together without fastening the joint base member 40 at the three-member intersecting position of the reinforced gypsum boards 20, the joint base member 40, and the wall stud 10. That is, the reinforced gypsum boards 20 and the wall stud 10 are screwed together with the screws 50 being absent in the area enclosed by a joint base member area and a wall stud area in the drawing. At the three-member intersecting position, the joint base member 40 is held and fixed between the reinforced gypsum boards 20 and the wall stud 10 without being screwed with the screws 50.

FIG. 4B illustrates a configuration where the reinforced gypsum boards 20 are screwed to the joint base member 40 and to the wall stud 10 with different screws 50 at a position off the three-member intersecting position of the reinforced gypsum boards 20, the joint base member 40, and the wall stud 10 at the three-member intersecting position. That is, the reinforced gypsum boards 20 are screwed to the joint base member 40 and to the wall stud 10 with different screws 50 with the screws 50 being absent in the area enclosed by a joint base member area and a wall stud area in the drawing. At the three-member intersecting position, the joint base member 40 is held and fixed between the reinforced gypsum boards 20 and the wall stud 10 without being screwed with the screws 50.

By applying the configuration as illustrated in FIG. 4A or 4B, namely, the configuration where the wall stud 10 and the joint base member 40 are not screwed with common screws 50, as behavior in the case of fire, deformation due to the thermal expansion of a wall stud and deformation due to the thermal expansion of a joint base member can follow respective deformations without interfering with each other. Therefore, it is possible to reduce stress due to the thermal expansion deformation of steel members applied to the reinforced gypsum boards 20 screwed to them. As a result, cracks can be prevented from occurring or are relatively reduced in size in the reinforced gypsum boards 20.

Figure 6:
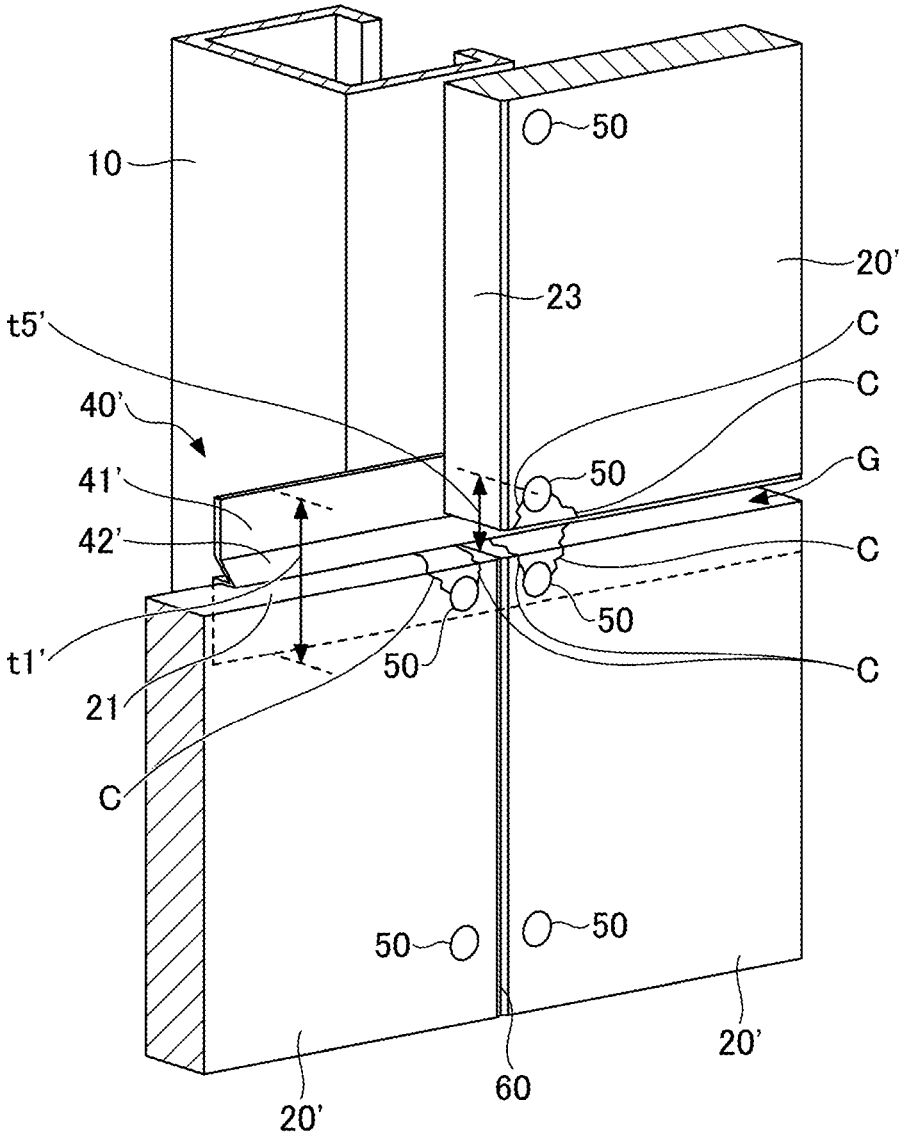
FIG. 6 is a perspective view illustrating a partition wall according to a comparative example, where reinforced gypsum boards, a joint base member, and the wall stud are screwed together with common screws.

While the reinforced gypsum boards 20 and the joint base members 40 are not screwed in the partition wall 100 illustrated in FIG. 1, a configuration may also be such that only the reinforced gypsum boards 20 and the joint base member 40 are fastened with the screws 50 at positions where the wall stud 10 is absent (positions off the wall stud 10) as illustrated in FIG. 4B. In this case, preferably, the reinforced gypsum board 20 and the joint base member 40 are fastened at a single position where there are no wall studs 10. This causes the number of screws 50 used to be as small as possible. It is also possible to fasten screws at lateral intervals of 75 mm or less. In the case as described above as well, compared with the case where the reinforced gypsum boards 20, the wall stud 10, and the joint base member 40 are fastened with common screws as illustrated in FIG. 6, it is possible to follow each of deformation due to the thermal expansion of the wall stud 10 and deformation due to the thermal expansion of the joint base member 40 as behavior in the case of fire. Therefore, cracks can be prevented from occurring or are relatively reduced in size in the reinforced gypsum boards 20.

As illustrated in FIG. 3, the joint base member 40 is formed by bending a single plate material (for example, a metal plate) as illustrated in FIG. 3. According to the joint base member 40 of the illustrated example, a projecting piece 42 projects from two back pieces 41 via two first bent parts 43, and the projecting piece 42 has a U-letter shape or V-letter shape including a second bent part 44.

Furthermore, according to the joint base member 40, the angle between the back pieces 41 and the projecting piece 42 is a predetermined angle θ that is less than 90 degrees. Here, the predetermined angle θ that is less than 90 degrees includes approximately 60 degrees to approximately 88 degrees.

The back pieces 41 and the projecting piece 42 have the predetermined angle θ that is less than 90 degrees. As a result, when the joint base member 40 is provided such that the projecting piece 42 is inserted between upper end faces 21 of the lower reinforced gypsum boards 20 and lower end faces 22 of the upper reinforced gypsum boards 20 as illustrated in FIG. 4, the ends of the back pieces 41 can gaplessly adhere to the back surfaces of the reinforced gypsum boards 20.

In this state, the back surface of the joint base member 40 is pressed against and fixed to the wall stud 10 behind the joint base member 40 to ensure that the joint base member 40 prevents (closes) gaps in the lateral joints 70. Accordingly, the leakage of heated air into the partition wall 100 through the lateral joints 70 can be effectively eliminated.

As illustrated in FIG. 3, according to the joint base member 40, an overall width t1 (width in a cross section) of the two back pieces 41 is 70 mm or more, and preferably, 90 mm or more. Furthermore, the projecting piece 42 is provided at the middle position of the two back pieces 41, and the projection length of the projecting piece 42 is within the range of 5 mm to 7 mm. Furthermore, a longitudinal length t3 of the joint base member 40 may be as long as approximately 1815 mm, which is over six spans, when the intervals u of the wall studs 10 are approximately 303 mm, for example.

Thus, the joint base member 40 has a high aspect ratio with the overall width being approximately 70 mm and the overall length being approximately 1815 mm. Therefore, the joint base member 40 is easily bendable during transportation or construction, and may plastically deform when the joint base member 40 is made of metal. The joint base member 40, however, includes the projecting piece 42 over its entire length at its widthwise center. Therefore, this projecting piece 42 provides the joint base member 40 with flexural rigidity, thus making it possible to control or prevent its bending or plastic deformation during transportation or construction.

As illustrated in FIG. 5, the reinforced gypsum board 20 includes a chamfered part 24 at the back side corner of the lower end face 22. A length t4 of this chamfered part 24 in the thickness direction of the reinforced gypsum board 20 is within the range of 7 mm to 9 mm.

Accordingly, when the joint base member 40 is provided on the back of the upper and lower reinforced gypsum boards 20, the projecting piece 42 whose projection length t2 is within the range of 5 mm to 7 mm can be accommodated inside the chamfered part 24.

Thus, when the projecting piece 42 is completely accommodated in the chamfered part 24, the lower end face 22 of the upper reinforced gypsum board 20 and the upper end face 21 of the lower reinforced gypsum board 20 can gaplessly contact each other as illustrated in FIG. 5, so that there is no gap in the lateral joints 70.

The above description is given of a chamfered part in the case of applying reinforced gypsum boards in a vertical position. In the case of applying reinforced gypsum boards in a horizontal position, the edges of boards whose sides are covered with gypsum board paper are caused to abut with each other (where examples of edge shapes include a beveled edge and a square edge). When the edge bent angle (the angle of a side surface covered with gypsum board paper at a board edge) is less than 90 degrees, the gap may be able to be a gap that can accommodate the projecting piece of a joint base member without chamfering. In this case, it is noted that lateral joints are prevented from being open. Even in the case of horizontal position application, chamfering is performed if necessary.

Furthermore, in actual construction, in FIG. 1, after the wall studs 10 are installed on the upper and lower runners 15 and 16 at the predetermined intervals u, the lower reinforced gypsum boards 20 are screwed to the wall studs 10. Next, after the projecting pieces 42 of the joint base members 40 are caught and fixed on the upper end faces 21 of the lower reinforced gypsum boards 20, the lower end faces 22 of the upper reinforced gypsum boards 20 are placed on the upper end faces 21 of the lower reinforced gypsum boards 20. In this state of placement, the projecting pieces 42 of the joint base members 40 are accommodated within the chamfered parts 24. By screwing the reinforced gypsum boards 20 and the wall studs 10 with the screws 50, the partition wall 100 is constructed. The reinforced gypsum boards 20 and the joint base members 40 may be fastened with the screws 50 as required.

The inventors of the present invention, etc., have confirmed that in this construction, because the projection length of the projecting pieces 42 is within the range of 5 mm to 7 mm and the upper end faces 21 of the lower reinforced gypsum boards 20 are horizontal flat surfaces, the joint base members 40 do not fall off when the projecting pieces 42 are caught on the upper end faces 21 of the reinforced gypsum boards 20 during construction. The upper end faces 21 of the lower reinforced gypsum boards 20 do not necessarily have to be horizontal flat surfaces. The upper end faces 21, however, are preferably horizontal flat surfaces especially in the case of the specifications for vertical position application of the illustrated example.

Thus, in terms of the workability that the joint base members 40 do not fall off when the projecting pieces 42 are caught on the upper end faces 21 of the reinforced gypsum boards 20 that are horizontal flat surfaces, the numerical value range (5 mm to 7 mm) of the projection length t2 of the projecting pieces 42 is determined. Furthermore, the numerical value range (7 mm to 9 mm) obtained by adding 2 mm to each of the upper and lower limit values of this projection length t2 of the projecting pieces 42 is determined as the length t4 of the chamfered parts 24 in the thickness direction of the reinforced gypsum boards 20.

Furthermore, as illustrated in FIG. 5, positions t5 at which the reinforced gypsum boards 20 are screwed to the wall stud 10 are set at positions off the back pieces 41, and the reinforced gypsum boards 20 and the wall stud 10 are screwed together at these set positions. These screwing positions may be set to positions that are t5 away from the projecting piece 42 at the center of the joint base member 40. For example, the distance of t5 may be within the range of 50 mm to 100 mm. The reinforced gypsum boards 20 may be screwed to the joint base member 40 at positions that are within the range of 25 mm to 40 mm from the projecting piece 42 at the center of the joint base member 40. Within this range, it is possible to effectively prevent cracks that can occur at ends of the reinforced gypsum boards 20 even when the screwing positions are positions where the back pieces 41 are present. Here, effects according to the above-described screwing positions of the reinforced gypsum boards 20 and the joint base member 40 is described while making a comparison with the comparative example illustrated in FIG. 6.

FIG. 6 is a perspective view illustrating that reinforced gypsum boards 20', a joint base member 40', and the wall stud 10 are screwed with common screws at their three-member intersecting position in the partition wall of the comparative example. The reinforced gypsum boards 20' according to the comparative example illustrated in FIG. 6 do not have chamfered parts in their lower end faces. Therefore, when a projecting piece 42' of the joint base member 40' is provided at the lateral joints of the upper and lower reinforced gypsum boards 20', a gap G commensurate with the entire thickness (U-shaped thickness) of the projecting piece 42' is produced. Such a gap G is likely to serve as a path for heated air in the case of fire and can be a cause of a significant decrease in the fire resistance capability of the partition wall.

Furthermore, an overall width t1' over two back pieces 41' of the joint base member 40' is approximately 50 mm. That is, the overall width t1' is significantly narrower than the overall width t1 (90 mm or more) of the joint base members 40 according to the embodiment. Therefore, the width of the single back piece 41' is approximately 25 mm, and naturally, the reinforced gypsum boards 20 are screwed to the joint base member 40 at positions approximately 10 mm from the projecting piece 42'. Accordingly, positions extremely close to cut ends of the reinforced gypsum boards 20' serve as screwing positions.

When the reinforced gypsum boards 20 are thus screwed to the joint base member 40 at positions close to cut ends, cracks C extending from the screws to the cut ends are likely to be caused by driving the screws as illustrated in FIG. 6. The verification performed by the inventors of the present invention, etc., has confirmed that the cracks C extending from the screws to the cut ends occur when the interval between the cut ends of the reinforced gypsum boards 20' and the screwing positions is approximately 10 mm as in the illustrated comparative example and has found that a block-shaped chip including multiple cracks C and a cut end may be broken off an end portion.

On the other hand, the inventors of the present invention, etc., have also confirmed that, for example, by screwing the reinforced gypsum boards 20 to the joint base member 40 at positions as distant as possible, for example, at positions 25 mm to 40 mm distant, from cut ends of the reinforced gypsum boards 20 as illustrated in FIG. 4B, the occurrence of cracks extending from screws to the cut ends of the reinforced gypsum boards 20 is eliminated.

Thus, in terms of preventing cracks from occurring in the reinforced gypsum boards 20, the range of intervals from the cut ends of the reinforced gypsum boards 20 to the screwing positions (approximately 25 mm to approximately 40 mm) is determined, and the overall width t1 (approximately 70 mm or more, preferably, 90 mm or more) with the two back pieces 41, each being able to ensure this interval range, is determined.

As described above, "Tiger Board Type Z, 25 mm in thickness" manufactured by YOSHINO GYPSUM CO., LTD. can be applied to the reinforced gypsum boards 20.

The illustrated partition wall 100 can be applied to not only steel buildings but also RC (Reinforced Concrete) buildings, wooden buildings, etc. Furthermore, buildings to which the partition wall 100 is applied include factories, warehouses, etc., in addition to common single-family homes.

According to the illustrated partition wall 100, it is possible to provide a partition wall that includes as small a number as possible of fire-resistant coverings to have good workability and effectively prevents a leak of heated air through lateral joints to have a good fire resistance capability. In contrast, in the case of the partition wall illustrated as a comparative example, where reinforced gypsum boards, a joint base member, and a wall stud are screwed with common screws, it is possible to increase the stiffness of the partition wall to suppress a finishing material (coating or cloth material) that may be applied to the surface of the partition wall being cut at joint parts when a building shakes because of an earthquake or the like. Surprisingly, however, it has been found that when the above-described three of the reinforced gypsum boards, the joint base member, and the wall stud are screwed with common screws, the strong binding of the three prevents the three from deforming to follow their respective behaviors of thermal contraction or thermal expansion in the case of fire as behavior in the case of fire, so that a large amount of stress is applied on the reinforced gypsum boards to make it easier for cracks to occur.

In contrast, it has been found that when reinforced gypsum boards are screwed to only a wall stud and a joint base member is fixed only by being inserted between the reinforced gypsum boards and the wall stud without being screwed with screws or the joint base member is fixed only by bonding with an adhesive and insertion in the case of fastening the reinforced gypsum boards to the wall stud and the joint base member as in the partition wall of the present disclosure, it is possible to follow each of the deformation of the wall stud due to thermal expansion and the deformation of the joint base member due to thermal expansion, so that cracks occurring in the reinforced gypsum boards are relatively reduced in size. Furthermore, it has been found that in the case of fastening reinforced gypsum boards to a wall stud and to a joint base member with different screws as well, it is possible to follow each of the deformation of the wall stud due to thermal expansion and the deformation of the joint base member due to thermal expansion, so that cracks occurring in the reinforced gypsum boards are relatively reduced in size.

[Fire Resistance Test]

Next, a fire resistance test conducted by the inventors of the present invention, etc., is described. In this fire resistance test, partition walls according to an example and a comparative example were made, and the fire resistance test was conducted according to the following test method to determine whether a 60-minute fire resistance test was passed or failed.

Example

As illustrated in FIG. 1, a partition wall was formed by vertically fitting multiple steel wall studs (size: 45 mm×45 mm×0.4 mm) to upper and lower steel runners (size: 45 mm×40 mm×0.4 mm) at intervals of approximately 303 mm, attaching a single-layer first wall and second wall formed of 25 mm reinforced gypsum boards one on each side of the steel wall studs by vertical position application, providing the wall studs on the back side of vertical joints, providing steel joint base members having a T-shaped cross section (size, etc.: a steel iron plate of 0.4 mm in thickness was bent, an overall width of 90 mm, a projection length of 5 mm of a projecting piece, and a length of 1815 mm) on the back side of lateral joints, screwing the reinforced gypsum boards to only the wall studs, and fixing the joint base members by inserting them between the reinforced gypsum boards and the wall studs. Chamfered parts of 7 mm in length in the thickness direction were formed at the back side corners of the lower end faces of the reinforced gypsum boards on the upper side of the joint base members to accommodate the above-described projecting parts of the joint base members.

Comparative Example

As illustrated in FIG. 6, a partition wall was formed by screwing the reinforced gypsum boards 20', the joint base members 40', and the wall studs 10 together with common screws at their three-member intersecting position.

Furthermore, the reinforced gypsum boards 20' according to the comparative example have no chamfered part in their lower end faces. Therefore, the projecting pieces 42' of the joint base members 40' are provided at the lateral joints of the upper and lower reinforced gypsum boards 20' to produce the gaps G commensurate with the entire thickness (U-shaped thickness) of the projecting pieces 42'.

Furthermore, the overall width t1' over the two back pieces 41' of the joint base member 40' is approximately 50 mm, and the width of the single back piece 41' is approximately 25 mm. The screwing positions of the reinforced gypsum boards 20' and the joint base members 40 are positions 10 mm from the projecting pieces 42'. By driving screws, cracks extending from the screws to cut ends were produced.

<Test Method>

According to the "fire prevention and resistance performance test and evaluation work method manual" specified by the designated performance evaluation organization, a wall surface of a partition wall was heated for one hour, and after additionally leaving it for three hours, measurement was performed to determine whether the increased temperature of the non-heated surface of the partition wall was 180° C. or less. As a result of the measurement, the case where the increased temperature of the non-heated surface exceeded 180° C. was considered fail, and the case where the increased temperature of the non-heated surface was 180° C. or less was considered pass.

<Test Results>

The partition wall of the example passed the 60-minute fire resistance test with the increased temperature of the non-heated surface being held at or below 180° C. In contrast, the partition wall of the comparative example failed the 60-minute fire resistance test because of the leakage of heated air through lateral joints during a heating test.

Other embodiments in which other constituent elements are combined with the configuration, etc., of the above-described embodiment may also be possible, and the present disclosure is not limited to the configuration shown herein. In this respect, changes may be made without departing from the intent of the present disclosure, and may be appropriately determined according to their form of application.

The present international application is based upon and claims priority to Japanese patent application No. 2018-186960, filed on Oct. 1, 2018, the entire contents of which are hereby incorporated herein by reference.

DESCRIPTION OF THE REFERENCE NUMERALS

10: wall stud (stud), 15: upper runner (runner), 16: lower runner (runner), 20: reinforced gypsum board (gypsum board), 21: upper end face, 22: lower end face, 23: side end face, 24: chamfered part, 30A: first wall, 30B: second wall, 40: joint base member, 41: back piece, 42: projecting piece, 43: first bent part, 44: second bent part, 50: screw, 60: vertical joint, 70: lateral joint, 100: partition wall (fire-resistant partition wall)

The invention claimed is:

1. A partition wall that is a fire-resistant partition wall, comprising:

a plurality of wall studs installed at predetermined intervals; and a first wall and a second wall that are a pair of walls provided across the plurality of wall studs from each other, the first wall and the second wall being formed of a plurality of vertically and laterally arranged gypsum boards, wherein each of the first wall and the second wall is a single-layer wall of the plurality of gypsum boards, vertical joints and lateral joints are formed in each of the first wall and the second wall, the wall studs are on a back side of the vertical joints, a joint base member having a fire blocking capability is provided at the lateral joints, the joint base member including a back piece contacting a back side of the gypsum boards and a projecting piece projecting from the back piece in a thickness direction of the gypsum boards, wherein a cross section of the joint base member perpendicular to a longitudinal direction thereof has a T-letter shape, the gypsum boards, the joint base member, and the wall studs are not screwed with a common screw, and (a) the gypsum boards are screwed to only the wall studs and are not screwed to the joint base member, and the joint base member is fixed to a position of the lateral joints by being inserted between the gypsum boards and the wall studs, or (b) the gypsum boards are screwed to the wall studs and to the joint base member with different screws, and the joint base member is fixed to a position of the lateral joints by being inserted between the gypsum boards and the wall studs.

2. The partition wall as claimed in claim 1, wherein chamfered parts are formed at back side corners of lower ends of the gypsum boards, the projecting piece of the joint base member is accommodated in the chamfered parts, and lower end faces of the gypsum boards on an upper side and upper end faces of the gypsum boards on a lower side gaplessly contact each other, and the chamfered parts are within a range of 7 mm to 9 mm in length in the thickness direction of the gypsum boards.

3. The partition wall as claimed in claim 1, wherein a width of the back piece in a cross section thereof is 70 mm or more, the projecting piece is at a middle position of the back piece, and a projection length of the projecting piece is within a range of 5 mm to 7 mm, and a position of the screwing in the back piece is a position 25 mm to 40 mm distant from the projecting piece.

4. The partition wall as claimed in claim 1, wherein an angle between the back piece and the projecting piece is a predetermined angle less than 90 degrees.

5. The partition wall as claimed in claim 1, wherein the joint base member is formed of one of a metal, wood, and a thermosetting resin.

6. The partition wall as claimed in claim 5, wherein the metal is one of steel, aluminum, and SUS.

7. The partition wall as claimed in claim 6, wherein the joint base member is a single plate member formed of the metal in which the projecting piece projects from two back pieces through two first bent parts and the projecting piece includes a second bent part to have a U-letter shape.

8. The partition wall as claimed in claim 1, wherein the gypsum boards are screwed to only the wall studs at a position off a three-member intersecting position of the gypsum boards, the joint base member, and the wall studs, and the joint base member is fixed by being inserted between the gypsum boards and the wall studs without being fastened with a screw at the three-member intersecting position.

9. The partition wall as claimed in claim 1, wherein the gypsum boards are screwed to the joint base member and to the wall studs with different screws at a position off a three-member intersecting position of the gypsum boards, the joint base member, and the wall studs, and the joint base member is fixed by being inserted between the gypsum boards and the wall studs without being fastened with a screw at the three-member intersecting position.

10. The partition wall as claimed in claim 1, wherein upper end faces and lower end faces of the gypsum boards are horizontal flat surfaces, and chamfered parts are formed at back side corners of the lower end faces of the gypsum boards, the projecting piece of the joint base member is accommodated in the chamfered parts to be placed on the flat surfaces of the gypsum boards on a lower side, and the lower end faces of the gypsum boards on an upper side and the upper end faces of the gypsum boards on the lower side gaplessly contact with each other, and the chamfered parts are within a range of 7 mm to 9 mm in length in the thickness direction of the gypsum boards.

11. The partition wall as claimed in claim 1, wherein the gypsum boards are reinforced gypsum boards and have a thickness of 25 mm.

* * * * *